US008791626B2

(12) United States Patent
Below et al.

(10) Patent No.: US 8,791,626 B2
(45) Date of Patent: Jul. 29, 2014

(54) SPARK PLUG WITH RING MEMBER COUPLED TO CENTER ELECTRODE THEREOF

(71) Applicant: Fram Group IP LLC, Lake Forest, IL (US)

(72) Inventors: Matthew B. Below, Findlay, OH (US); Jeffrey T. Boehler, Holland, OH (US); Jerry Williams Reeves, Jr., Toledo, OH (US); Philip Treier, Perrysburg, OH (US)

(73) Assignee: Fram Group IP LLC, Lake Forest, IL (US)

( * ) Notice: Subject to any disclaimer, the term of this patent is extended or adjusted under 35 U.S.C. 154(b) by 0 days.

(21) Appl. No.: 13/736,443

(22) Filed: Jan. 8, 2013

(65) Prior Publication Data

US 2013/0193833 A1 Aug. 1, 2013

Related U.S. Application Data

(60) Provisional application No. 61/591,607, filed on Jan. 27, 2012.

(51) Int. Cl.
*H01T 13/20* (2006.01)
*H01T 21/02* (2006.01)
*H01T 13/32* (2006.01)

(52) U.S. Cl.
CPC ..... *H01T 13/20* (2013.01); *H01T 21/02* (2013.01); *H01T 13/32* (2013.01)
USPC ..... 313/139; 313/118; 313/138

(58) Field of Classification Search
CPC ..... H01T 13/32; H01T 21/02; H01T 13/20; H01T 13/00; H01T 1/20; H01T 1/22; H01T 13/39; H01T 13/05; H01T 13/02; H01T 13/28
USPC ..... 313/118–145; 123/169 R, 169 EL, 32, 123/41, 310
See application file for complete search history.

(56) References Cited

U.S. PATENT DOCUMENTS

| | | | | |
|---|---|---|---|---|
| 4,439,708 | A * | 3/1984 | Hattori et al. | 313/140 |
| 4,841,925 | A * | 6/1989 | Ward | 123/143 B |
| 5,577,471 | A * | 11/1996 | Ward | 123/169 EL |
| 6,095,124 | A * | 8/2000 | Matsubara et al. | 123/594 |
| 6,495,948 | B1 * | 12/2002 | Garrett, III | 313/141 |
| 2009/0139479 | A1 * | 6/2009 | Johng | 123/169 R |
| 2010/0133976 | A1 * | 6/2010 | Siegel | 313/141 |
| 2010/0275869 | A1 * | 11/2010 | Musasa et al. | 123/169 EL |
| 2010/0320893 | A1 * | 12/2010 | Kato | 313/141 |
| 2011/0148274 | A1 * | 6/2011 | Ernst et al. | 313/141 |

* cited by examiner

*Primary Examiner* — Nimeshkumar Patel
*Assistant Examiner* — Jose M Diaz
(74) *Attorney, Agent, or Firm* — Erin J. Fox; Barnes & Thornburg LLP

(57) ABSTRACT

A spark plug includes an insulator having a first end, the insulator having a center axis and a center electrode coupled to the insulator and having a center electrode tip extending beyond the first end of the insulator. The spark plug further includes a ground electrode having an end spaced from an end of the center electrode, the ground electrode having a first portion extending substantially parallel to the center axis and a second portion extending at an angle from the first portion and relative to the center axis. A ground electrode tip is disposed on the second portion of the ground electrode, wherein the ground electrode tip is spaced from the center electrode tip. A ring member is operatively connected to the center electrode proximate the center electrode tip.

19 Claims, 4 Drawing Sheets

SPARK PLUG WITH RING MEMBER COUPLED TO CENTER ELECTRODE THEREOF

BACKGROUND

1. Field of the Invention

The present invention relates generally to spark plugs and, more particulary to spark plugs having an electrode that facilitates propagation of a burn front.

2. Description of the Background

The subject matter disclosed herein relates to a spark plug for use with an internal combustion engine, and more particularly to a spark plug having a structure providing improved flame kernel development.

Conventional spark plugs for use in internal combustion engines generally include a tube-shaped metallic shell, an insulator, a center electrode and a ground electrode. The metal shell has a threaded portion for fitting the spark plug into a combustion chamber for the engine. The insulator has a center bore formed therein and is fixed in the metal shell such that an end of the insulator protrudes from the end of the metal shell. The center electrode is positioned within the center bore of the insulator and protrudes outwardly of the insulator. The ground electrode has a first end that is joined to an end of the metal shell and curves such that a second end including a tip portion faces an end of the center electrode to create a gap.

The gap between the end of the center electrode and the tip portion of the ground electrode is generally perpendicular to the axis of the spark plug. As a result, the direction of the burn front is limited, at least initially, in a sideways direction relative to the spark plug axis. The burn front must travel around the ground electrode structure, which slows the speed of the burn front. Further, this movement also draws thermal energy from the burn front, which could be used to keep the burn front ignited and expanding.

Accordingly, while existing spark plugs are suitable for their intended purposes, the need for improvement remains, particularly in providing a spark plug with an electrode structure that facilitates propagation of the burn front.

SUMMARY

In an illustrative embodiment, a spark plug includes an insulator having a first end, the insulator having a center axis and a center electrode coupled to the insulator and having a center electrode tip extending beyond the first end of the insulator. The spark plug further includes a ground electrode having an end spaced from an end of the center electrode, the ground electrode having a first portion extending substantially parallel to the center axis and a second portion extending at an angle from the first portion and relative to the center axis. A ground electrode tip is disposed on the second portion of the ground electrode, wherein the ground electrode tip is spaced from the center electrode tip. A ring member is operatively connected to the center electrode proximate the center electrode tip.

In a further illustrative embodiment, a spark plug includes a metal shell having a bore extending axially therethrough and an insulator at least partially disposed in the metal shell, the insulator having a first end and a center axis. The spark plug further includes a center electrode disposed within the insulator and having a center electrode tip extending beyond the first end of the insulator. A ground electrode is coupled to the metal shell, wherein the ground electrode includes a first portion extending relatively parallel to the center axis and a second portion extending from the first portion, the second portion being disposed at a first angle relative to the center axis. A ground electrode tip is disposed on the second portion of the ground electrode, wherein the ground electrode tip is proximate the center electrode tip. A ring member is operatively connected to the center electrode proximate the electrode tip.

In another illustrative embodiment, a method of making a spark plug includes the step of placing a center electrode at least partially within a central bore of an insulator and operatively coupling the center electrode to the insulator, wherein a center electrode tip extends beyond the insulator. The method further includes the step of disposing a ground electrode proximate the center electrode, wherein the ground electrode includes a first portion extending substantially parallel to the center axis and a ground electrode tip disposed at an end of the ground electrode. The method further includes the step of operatively coupling a ring member to the center electrode proximate the center electrode tip.

BRIEF DESCRIPTION OF THE DRAWINGS

The subject matter, which is regarded as the invention, is particularly pointed out and distinctly claimed in the claims at the conclusion of the specification.

The foregoing and other features, and advantages of the invention are apparent from the following detailed description taken in conjunction with the accompanying drawings in which.

Other aspects and advantages of the present invention will become apparent upon consideration of the following detailed description, wherein similar structures have like or similar reference numerals.

Detailed Description

The present invention is directed to spark plugs. While the spark plugs of the present invention may be embodied in many different forms, several specific embodiments are discussed herein with the understanding that the present invention is to be considered only as an exemplification of the principles of the invention, and it is not intended to limit the invention to the embodiments illustrated.

Figure 1:
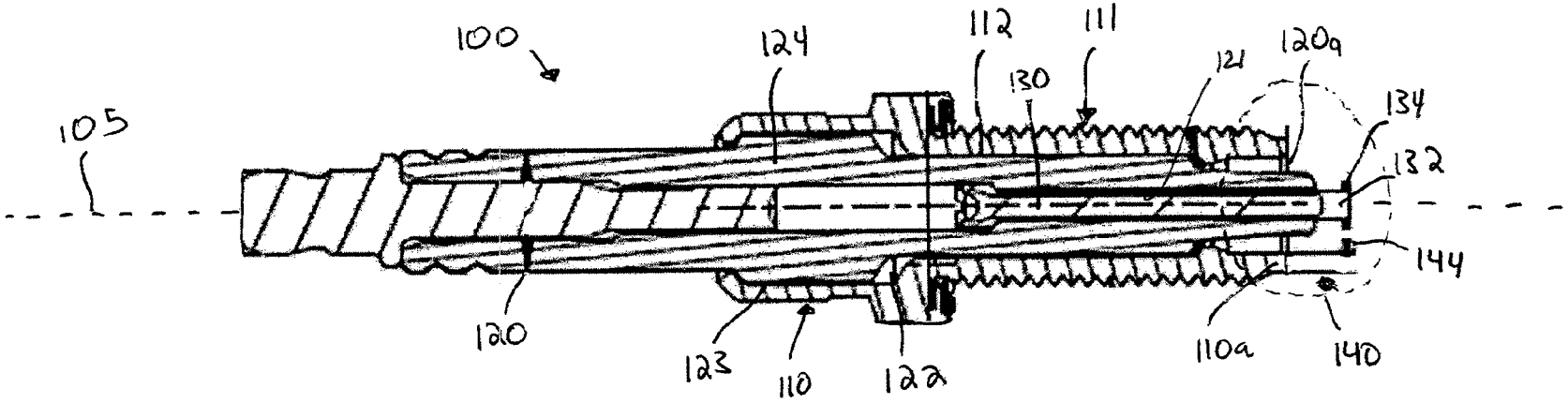
FIG. 1 is a side, cross-sectional view of a spark plug in accordance with an illustrative embodiment.
Figure 2:
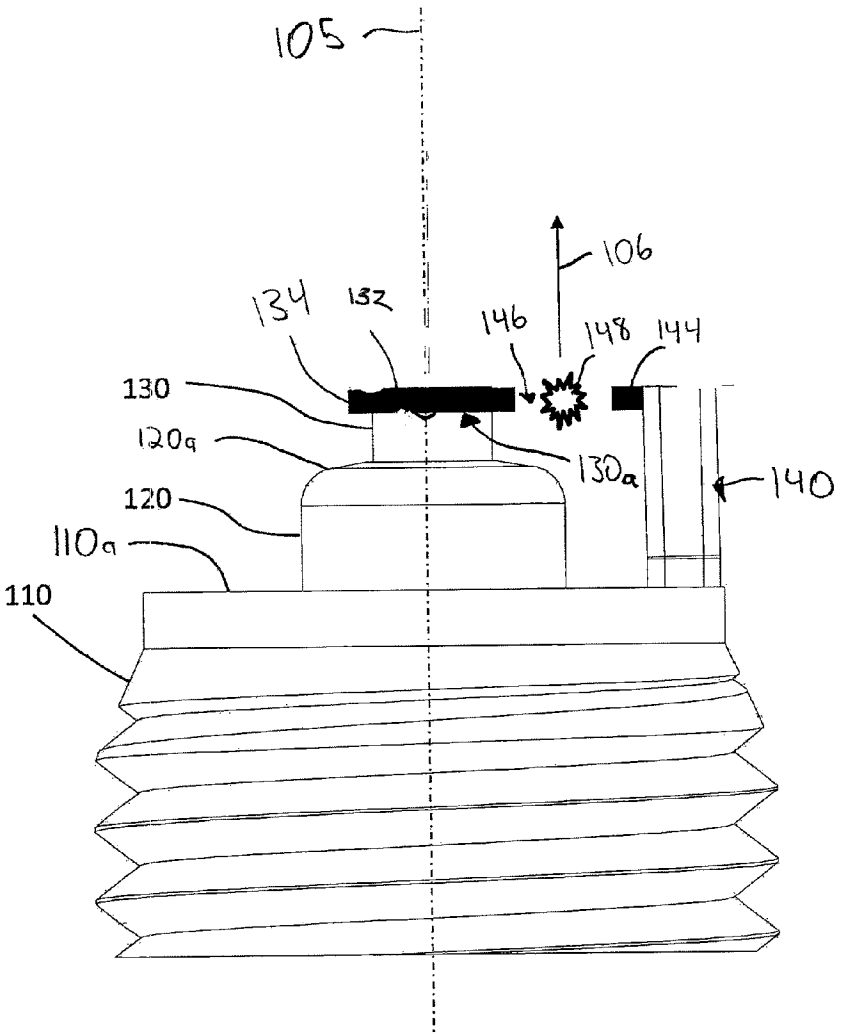
FIG. 2 is an enlarged, side elevational view of an electrode end of the spark plug of FIG. 1.

Referring to FIGS. 1 and 2, a spark plug 100 includes an electrode structure configured to direct the burn front of a flame into a combustion chamber (not shown). The spark plug 100 is designed for use in internal combustion engines of automobile vehicles. The installation of the spark plug 100 into an internal combustion engine is achieved by fitting it so that it protrudes into a combustion chamber through a threaded bore provided in the engine head (not shown).

The spark plug 100 includes a tube-shaped metal shell 110, an insulator 120, a center electrode 130, and a ground electrode 140. The ground electrode 140 is coupled to the metal shell 110 on the combustion chamber side of the spark plug 100.

The metal shell 110 is made from a conductive metal material, such as steel, for example. The metal shell 110 has a threaded shank portion 111 on an outer periphery. The threaded portion 111 cooperates with a thread in an engine head within a combustion chamber of an engine to couple the spark plug 100 to the engine. The metal shell 110 also includes an axial bore 112 that extends along its length.

The insulator 120 is an elongated component that is at least partially disposed within the axial bore 112 of the metal shell 110. The insulator 120 may be made from a non-conducting ceramic material, such as, but not limited to, alumina ceramic, for example. This arrangement allows the center electrode 130 to be retained within the insulator 120 while preventing an electrical conductive path from forming between the center electrode 130 and the metal shell 110. The insulator 120 is coupled to the metal shell 110 such that an end 120*a* of the insulator protrudes from an end 110*a* of the metal shell 110. The insulator 120 includes an axial bore 121 with a center axis 105 therethrough. The axial bore 121 extends through the insulator 120 and is sized to fit the center electrode 130. The insulator 120 may also include exterior shoulders 122, 123 arranged at either end of an expanded flange portion 124.

In an illustrative embodiment, the center electrode 130 may be made from an electrically conductive and highly heat conductive metal material, such as, but not limited to, copper, for example, as a core material. In an illustrative embodiment, the core material may be cladding that is made from a heat resistant, corrosion-resistant metal material, such as, but not limited to, a solid nickel alloy or Inconel, for example. The center electrode 130 may also be made from a nickel based alloy without having a separate core and cladding component. The center electrode 130 is secured in the axial bore 121 of the insulator 120 such that the center electrode 130 is electrically isolated from the metal shell 110. The center electrode 130 includes an end 130*a* that is arranged to protrude beyond the end 120*a* of insulator 120. The end 130*a* of the center electrode 130 may take on a number of configurations, including, but not limited to, a cylindrical body that extends in a direction parallel, or relatively parallel, to the center axis 105 and/or may include a center electrode tip 132 comprising a flat, blunt face, or alternatively various other shapes, such as a conical end, for example.

A ring member 134 is coupled to the end 130*a* of the center electrode 130. The ring member 134 may be coupled by any suitable means, such as laser welding, brazing, mechanical fasteners, or any other suitable fastener or fastening method, to the center electrode tip 132. Irrespective of the manner in which the ring member 134 is coupled to the center electrode 130, the ring member 134 is coupled to the center electrode tip 132 after the center electrode 130 is assembled into the insulator 120. The ring member 134 at least partially circumferentially surrounds the center electrode tip 132 and provides positioning flexibility, with respect to spark gap formation between the center electrode 130 and the ground electrode 140. By positioning flexibility, it should be appreciated that the center electrode tip 132 typically requires specific alignment with the ground electrode 140 in order to form a desired spark gap; however, the ring member 134 alleviates the need for orientation of the assembly by providing a more tolerant surface that is capable of forming the spark gap with the ground electrode 140.

The ground electrode 140 is coupled to the metal shell 110 at the end 110*a* of the metal shell 110. The ground electrode 140 may be made from an electrically conductive metal material, such as a nickel-based material, for example. The ground electrode 140 may take on a number of configurations, including a substantially straight shaped member that is parallel, or substantially parallel, to the center axis 105. The ground electrode 140 includes a ground electrode tip 144 on a side face opposite the ring member 134. The ground electrode tip 144 may be coupled to the ground electrode 140 by any suitable method, such as welding, for example. In an illustrative embodiment, the ground electrode tip 144 is welded to a face of the ground electrode 140 after the ground electrode 140 is welded to the metal shell 110. The ring member 134 and the ground electrode tip 144 cooperate to form a gap 146 across which an arc 148 forms during operation. It is noted that the spark plug 100 may optionally include a plurality of ground electrodes, disposed at various locations from one another, depending on the application of use.

Figure 3:
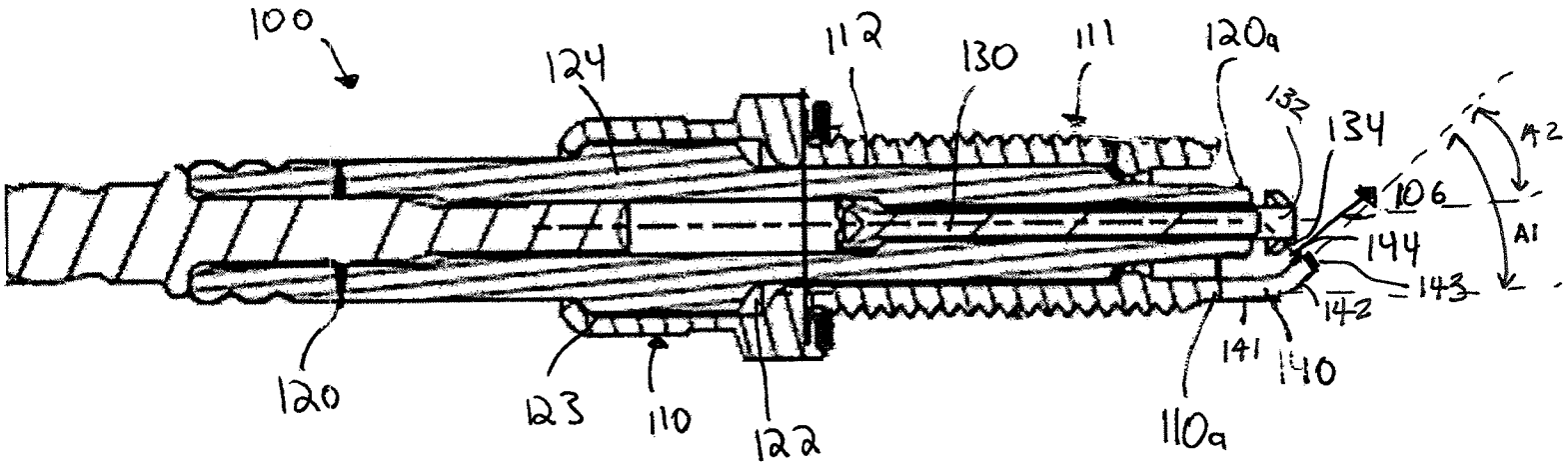
FIG. 3 is a side, cross-sectional view of a spark plug in accordance with a further illustrative embodiment.

Referring now to FIG. 3, the ground electrode 140 may also be formed of a J-shaped member having a first portion 141 that extends from the metal shell 110 and that may be generally parallel to the center axis 105 and a second portion 142 that is arranged at an angle relative to the first portion 141 and to the center axis 105. An end of the second portion 142 may include chamfered surfaces 143. As will be discussed in more detail below, the chamfered surfaces 143 assist in reducing the profile of the ground electrode 140, which reduces the flame impingement on the second portion 142. In an illustrative embodiment, the second portion 142 is disposed at an angle A1 of about 45 degrees relative to the first portion 141 and at an angled A2 of about 45 degrees relative to the center axis 105. It should be appreciated that several other angles between about 0 degrees and about 90 degrees may be employed, as described below.

It should be appreciated that the arrangement of the gap 146 at an angle of less than 90 degrees such that the second portion 142 is not perpendicular to the center axis 105 provides advantages in reducing the impingement of the ground electrode 140 on the burn front, particularly when the second portion 142 of the ground electrode 140 is aligned parallel to the center axis 105. In such an alignment, flame impingement reduction is most apparent. The burn front is directed toward the combustion chamber as indicated by arrow 106. This causes an increased speed of flame kernel development. This arrangement provides further advantages in reducing the height of the ground electrode 140 to reduce the surface area to further reduce the amount of flame impingement. This arrangement provides still further advantages in that the reduced height of the ground electrode 140 allows for the tip members 134, 144 to be welded onto the center electrode 130 and ground electrode 140, respectively, after assembly of the spark plug 100.

It should further be appreciated that since a more efficient burn front is created by the spark plug 100, a smaller diameter center electrode 130 may be used. This allows for a larger cross-sectional thickness of the insulator 120, which provides advantages in improving the thermal insulation of the center electrode 130 from the engine temperatures. Alternatively, or in addition, the smaller diameter center electrode 130 may allow for a smaller overall diameter spark plug.

Figure 4:
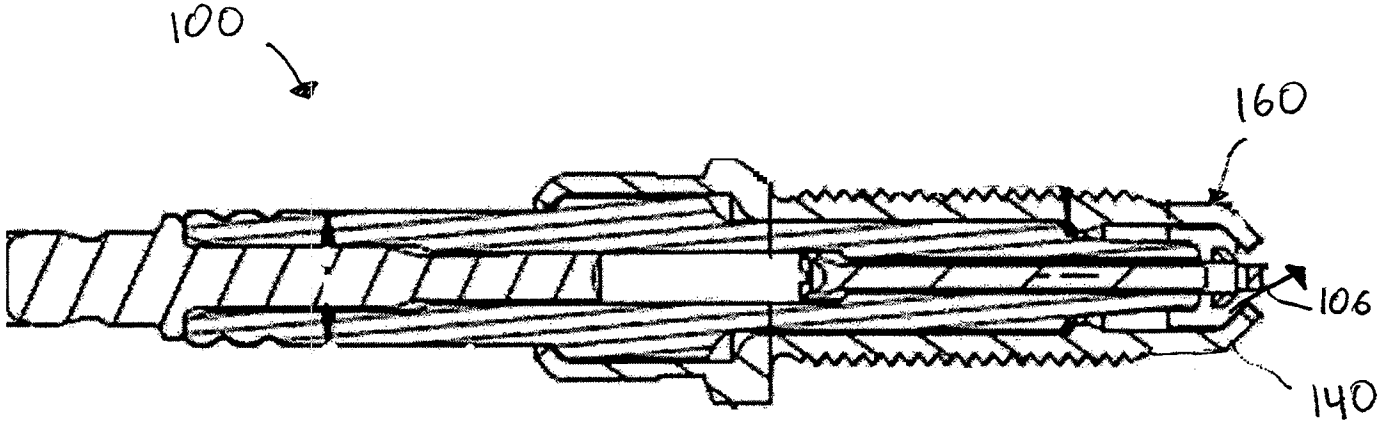
FIG. 4 is a side, cross-sectional view of a spark plug in accordance with another illustrative embodiment.

Referring now to FIG. 4, an illustrative embodiment of the spark plug 100 similar to that illustrated in FIG. 3 is shown. The spark plug 100 includes a second ground electrode 160 that is similar to that of ground electrode 140.

Any of the embodiments described herein may be modified to include any of the structures or methodologies disclosed in connection with other embodiments.

Further, although directional terminology, such as front, back, top, bottom, upper, lower, etc. may be used throughout the present specification, it should be understood that such terms are not limiting and are only utilized herein to convey the orientation of different elements with respect to one another.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

We claim:

1. A spark plug comprising:

an insulator having a first end, the insulator having a center axis;

a center electrode coupled to the insulator and having a center electrode tip extending beyond the first end of the insulator;

a ground electrode having an end spaced from an end of the center electrode, the ground electrode having a first portion extending substantially parallel to the center axis and a second portion extending at an angle from the first portion and relative to the center axis;

a discrete ground electrode tip disposed on the second portion of the ground electrode, wherein the ground electrode tip is spaced from the center electrode tip; and a ring member operatively connected to the center electrode proximate the center electrode tip, wherein the ring member includes a top annular surface that is disposed at an angle with respect to the center axis but is not perpendicular to the center axis;

wherein the ring member has a diameter that is greater than a diameter of the center electrode after attachment to the center electrode such that the ring member extends beyond an outer periphery of the center electrode;

wherein the ground electrode tip is spaced from an edge of the ring member to create a spark gap.

2. The spark plug of claim 1, wherein the ring member is laser welded to the center electrode.

3. The spark plug of claim 1, wherein the ring member is mechanically fastened to the center electrode.

4. The spark plug of claim 1, wherein the ring member is brazed to the center electrode.

5. The spark plug of claim 1, wherein the ring member circumferentially surrounds the center electrode proximate the center electrode tip.

6. The spark plug of claim 5, wherein the ground electrode tip is aligned substantially perpendicular to the second portion of the ground electrode.

7. The spark plug of claim 5, wherein the angle between the first portion and the second portion is between about 30 degrees and about 60 degrees.

8. The spark plug of claim 5, wherein the angle between the first portion and the second portion is approximately 45 degrees.

9. The spark plug of claim 1, wherein the ring member is a solid ring attached to an end surface of the center electrode tip.

10. The spark plug of claim 1, further comprising:

a second discrete ground electrode coupled to the insulator opposite the first-named ground electrode, the second ground electrode having a third portion extending parallel to the center axis and a fourth portion extending from the third portion, the fourth portion being disposed at an angle relative to the center axis, the angle being less than 90 degrees; and a second electrode tip disposed spaced from the center electrode tip;

wherein the first and second ground electrodes are not connected to one another.

11. A spark plug comprising:

a metal shell having a bore extending axially therethrough;

an insulator at least partially disposed in the metal shell, the insulator having a first end and a center axis;

a center electrode disposed within the insulator and having a center electrode tip extending beyond the first end of the insulator;

a ground electrode coupled to the metal shell at a single point;

a ground electrode tip disposed on the ground electrode, wherein the ground electrode tip is proximate the center electrode tip; and a ring member operatively connected to the center electrode proximate the center electrode tip, wherein the ring member includes a top annular surface that is disposed at an angle with respect to the center axis but is not perpendicular to the center axis;

wherein the ring member has a diameter that is greater than a diameter of the center electrode after attachment to the center electrode such that the ring member extends beyond an outer periphery of the center electrode;

wherein the ground electrode tip is spaced from an edge of the ring member to create a spark gap, and wherein the ground electrode tip includes a tip surface that is parallel with the top angular surface of the ring member.

12. The spark plug of claim 11, wherein the ring member is laser welded to the center electrode.

13. The spark plug of claim 11, wherein the ring member is mechanically fastened to the center electrode.

14. The spark plug of claim 11, wherein the ring member is brazed to the center electrode.

15. The spark plug of claim 11, wherein the ring member circumferentially surrounds the center electrode proximate the center electrode tip.

16. The spark plug of claim 11, wherein the ring member is a solid ring attached to an end surface of the center electrode tip.

17. The spark plug of claim 11, further comprising:

a second ground electrode coupled to the insulator opposite the first-named ground electrode; and a second electrode tip disposed on the second ground electrode and spaced from the center electrode tip;

wherein the first and second ground electrodes are not connected to one another.

18. A method of making a spark plug comprising:

placing a center electrode at least partially within a central bore of an insulator and operatively coupling the center electrode to the insulator, wherein a center electrode tip extends beyond the insulator;

disposing a ground electrode proximate the center electrode, the ground electrode being formed of a single member coupled to the metal shell at a single point and including a ground electrode tip disposed at an end of the ground electrode; and operatively coupling a ring member to the center electrode proximate the center electrode tip, wherein the ring member includes a top annular surface that is disposed at an angle with respect to the center axis but is not perpendicular to the center axis;

wherein the ring member has a diameter that is greater than a diameter of the center electrode after attachment to the center electrode such that the ring member extends beyond an outer periphery of the center electrode, wherein the ground electrode tip is spaced from an edge of the ring member to create a spark gap.

19. The method of claim 18, wherein the ring member is a solid ring attached to an end surface of the center electrode tip.

* * * * *